US012110908B1

(12) United States Patent
Karavich et al.

(10) Patent No.: US 12,110,908 B1
(45) Date of Patent: Oct. 8, 2024

(54) WEARABLE AIR CIRCULATION DEVICES AND METHODS OF USE

(71) Applicant: TIGERAIRE, INC., Richmond, VA (US)

(72) Inventors: Jack Lehmejian Karavich, Glen Allen, VA (US); Marco Antonio Falconi, Washington, DC (US)

(73) Assignee: Tigeraire, Inc., Richmond, VA (US)

( * ) Notice: Subject to any disclaimer, the term of this patent is extended or adjusted under 35 U.S.C. 154(b) by 0 days.

(21) Appl. No.: 18/233,750

(22) Filed: Aug. 14, 2023

(51) Int. Cl.

| | |
|---|---|
| ***F04D 29/62*** | (2006.01) |
| ***F04D 17/16*** | (2006.01) |
| ***F04D 25/06*** | (2006.01) |
| ***F04D 25/08*** | (2006.01) |
| ***F04D 27/00*** | (2006.01) |

(52) U.S. Cl.
CPC ..... *F04D 29/624* (2013.01); *F04D 25/0673* (2013.01); *F04D 25/084* (2013.01); *F04D 27/008* (2013.01); *F04D 17/16* (2013.01)

(58) Field of Classification Search
CPC .. F04D 29/624; F04D 25/0673; F04D 25/084; F04D 27/008; F04D 17/16
See application file for complete search history.

(56) References Cited

U.S. PATENT DOCUMENTS

2022/0016448 A1* 1/2022 Cran ..... A62B 18/08

FOREIGN PATENT DOCUMENTS

| | | | | |
|---|---|---|---|---|
| CN | 110841209 B | * | 11/2021 | ..... A62B 23/02 |
| CN | 215633886 U | * | 1/2022 | |
| KR | 102571655 B1 | * | 12/2020 | ..... F04D 25/08 |
| WO | WO-2008065932 A1 | * | 6/2008 | ..... F04D 29/4226 |
| WO | WO-2021133093 A1 | * | 7/2021 | |

* cited by examiner

*Primary Examiner* — Woody A Lee, Jr.
*Assistant Examiner* — Eric A Lange
(74) *Attorney, Agent, or Firm* — Sterne, Kessler, Goldstein Fox P.L.L.C.

(57) ABSTRACT

A personal cooling device includes a first arm. The first arm comprises a fan. The fan comprises a centrifugal impeller. The device further includes a second arm pivotably coupled to the first arm by a hinge. The second arm is biased relative to the first arm about the hinge and configured to secure the device to a garment (or article or object) by pinching the garment against the first arm.

19 Claims, 11 Drawing Sheets

WEARABLE AIR CIRCULATION DEVICES AND METHODS OF USE

BACKGROUND

In various occupational, recreational, and athletic settings, individuals often face challenging environmental conditions, particularly during periods of extreme heat. High temperatures and humidity levels can lead to discomfort, fatigue, and reduced performance during physical activities, affecting both professional and leisurely pursuits. Whether engaged in physically demanding jobs, sports, outdoor adventures, or other activities, individuals may experience adverse effects on their well-being, productivity, and overall performance.

The human body relies on an efficient thermoregulation system to maintain a stable core temperature during exertion. However, during extreme heat, this natural cooling mechanism becomes strained, leading to an increased risk of heat-related illnesses, such as heat exhaustion and heat stroke. These conditions not only compromise the individual's health and safety but also impede their ability to perform at optimal levels, potentially leading to reduced work efficiency, decreased athletic performance, and diminished overall enjoyment of leisure activities.

Existing cooling solutions, such as passive cooling garments, and fixed or handheld fans, often fall short in providing sustained relief during extended periods of intense heat. Additionally, traditional cooling methods may lack versatility, practicality, potency, and portability when facing field conditions, further limiting their effectiveness and usability.

BRIEF SUMMARY

There is a need for an innovative wearable air circulation device that can efficiently and continuously deliver a cooling airflow to individuals during extreme heat conditions. Such a device could be lightweight, compact, and unobtrusive to ensure ease of use and comfort. Moreover, the wearable air circulation device could be adaptable for integration into a wide range of apparel, sports gear, work uniforms, articles of clothing, or fixtures.

Aspects of the present disclosure address the challenges posed by extreme heat by providing a wearable air circulation device that delivers a continuous flow of cool air to the user, enhancing thermoregulation, reducing discomfort, and maintaining optimal performance levels during physical activities. By effectively dissipating heat and facilitating heat exchange, wearable air circulation devices can to mitigate the adverse effects of extreme heat on individuals engaged in work, sports, or leisure pursuits, ultimately promoting safety, well-being, and productivity in demanding environmental conditions.

An aspect of the present disclosure relates to a personal cooling device that comprises a fan for blowing air and a clip for securing the device to a garment or article of apparel. The fan can be integrated into the clip. The clip can comprise a housing that encloses the fan. Either or both of an impeller and a motor of the fan can be contained in the housing. The clip can comprise a portion of the housing and an arm biased toward the portion of the housing to enable a portion of a garment or article of apparel to be pinched between the arm and the portion of the housing. The portion of the housing can be a first portion of the housing and the arm can be a second portion of the housing. The fan can comprise a centrifugal impeller disposed in a volute defined within a portion of the housing. The fan can be configured to draw air through an airflow inlet on a first side of the housing and expel the air through an airflow outlet on a second side of the housing.

According to some aspects of the present disclosure, a personal cooling device may comprise a first arm comprising a fan. The fan may comprise a centrifugal impeller. The personal cooling device may also comprise a second arm comprising a battery. The second arm may be pivotably coupled to the first arm by a hinge. The second arm may be biased relative to the first arm about the hinge and configured to secure the device to an article by pinching the article between the first arm and the second arm. The second arm may be biased relative to the hinge to bring the fan and the battery closer together.

In some embodiments according to the foregoing, the first arm may comprise a first end, a second end opposite the first end, and an airflow outlet defined in the first end. The airflow outlet may be configured to direct air radially away from the impeller. The hinge may be disposed nearer to the second end of the first arm than the first end of the first arm.

In some embodiments according to any of the foregoing, the first arm may comprise an airflow inlet disposed in a housing of the first arm and configured to receive air axially relative to the impeller.

In some embodiments according to any of the foregoing, the first arm may comprise a volute within which the impeller is disposed. The first arm may also comprise an airflow inlet disposed in a housing of the first arm and configured to allow air into the volute along an axis of rotation of the centrifugal impeller. The first arm may also comprise an airflow outlet configured to direct air out of the volute and out of the first arm radially relative to the axis of rotation of the centrifugal impeller.

In some embodiments according to any of the foregoing, the volute may be a scroll volute.

In some embodiments according to any of the foregoing, the airflow outlet may direct a portion of air out of the first arm in an outlet direction. The outlet direction may comprise both a radial component and an axial component relative to the axis of rotation of the centrifugal impeller.

In some embodiments according to any of the foregoing, the axial component may be an outlet axial component and the airflow inlet is configured to allow air into the volute in an inlet direction. The inlet direction may comprise an inlet axial component. The outlet axial component may be opposite from the inlet axial component.

In some embodiments according to any of the foregoing, the first arm may comprise an outlet end and an airflow outlet defined in the outlet end. The airflow outlet may be configured to direct air radially away from the impeller, and the outlet end is disposed on a receiving side of the hinge. The second arm may comprise a grip end that is on the receiving side of the hinge. The second arm may be, and biased relative to the first arm about the hinge toward decreasing an angle between the first arm and the second arm on the receiving side of the hinge.

In some embodiments according to any of the foregoing, the personal cooling device may comprise an outer side that is opposite from the receiving side of the hinge. The personal cooling device may also comprise a light configured to direct light from the outer side.

In some embodiments according to any of the foregoing, the second arm may comprise a lamp end opposite from the grip end, and the light is directed through the lamp end.

In some embodiments according to any of the foregoing, either or both of the first arm and the second arm may comprise a grip facing the other of the first arm and the second arm on the receiving side of the hinge.

In some embodiments according to any of the foregoing, the first arm may comprise the grip. The grip may extend on a grip plane. The airflow outlet may be configured to direct airflow transverse to the grip plane as the airflow exits the personal cooling device.

In some embodiment according to any of the foregoing, the second arm may comprise the grip. A distal end of the grip end may be further from the hinge than a distal end of the outlet end such that the second arm is biased about the hinge to bring the grip into contact with the outlet end.

According to some aspects, a personal cooling device may comprise a housing. The personal cooling device may also comprise a clip defined at least partially by the housing. The clip may be configured to receive a portion of a garment to releasably secure the housing to the garment. The clip may comprise a first arm and a second arm coupled by a pivoting mechanical hinge. The personal cooling device may also comprise a fan configured to draw air through an inlet in the housing in an inlet direction and expel the air in an outlet direction that is transverse to the inlet direction. The first arm may comprise the fan. The second arm may comprise a battery.

In some embodiments according to the foregoing, the first arm and the second arm may each comprise a respective end spaced from the hinge. The a receiving direction along which a garment may travel to be securably received in the clip may extend through a point between the respective ends of the first arm and the second arm toward the hinge. An angle defined between the receiving direction and the outlet direction is at least 90°.

In some embodiments according to any of the foregoing, the housing may comprise a first portion and a second portion, wherein the first portion contains the fan and the second portion is movable relative to the first portion.

In some embodiments according to any of the foregoing, the personal cooling device may comprise a controller and a switch. The switch may be coupled to the second portion of the housing. The controller may be configured to activate or deactivate the fan in response to actuation of the switch.

In some embodiments according to any of the foregoing, the personal cooling device may comprise a switch configured to detect whether an object is retained by the clip. The personal cooling device may also comprise a controller configured to activate the fan when the switch detects that an object is retained by the clip.

In some embodiments according to any of the foregoing, the personal cooling device may comprise a sensor configured to detect ambient conditions. The personal cooling device may also comprise a controller configured to activate or deactivate the fan in response to the ambient conditions detected by the sensor relative to a predetermined threshold.

In some embodiments according to any of the foregoing, the sensor may be a thermometer and the ambient conditions may comprise temperature.

BRIEF DESCRIPTION OF THE DRAWINGS

The accompanying drawings illustrate embodiments of the present disclosure and, together with the description, further serve to explain the principles of the disclosure and to enable a person skilled in the pertinent art to make and use the disclosure.

Figure 1:
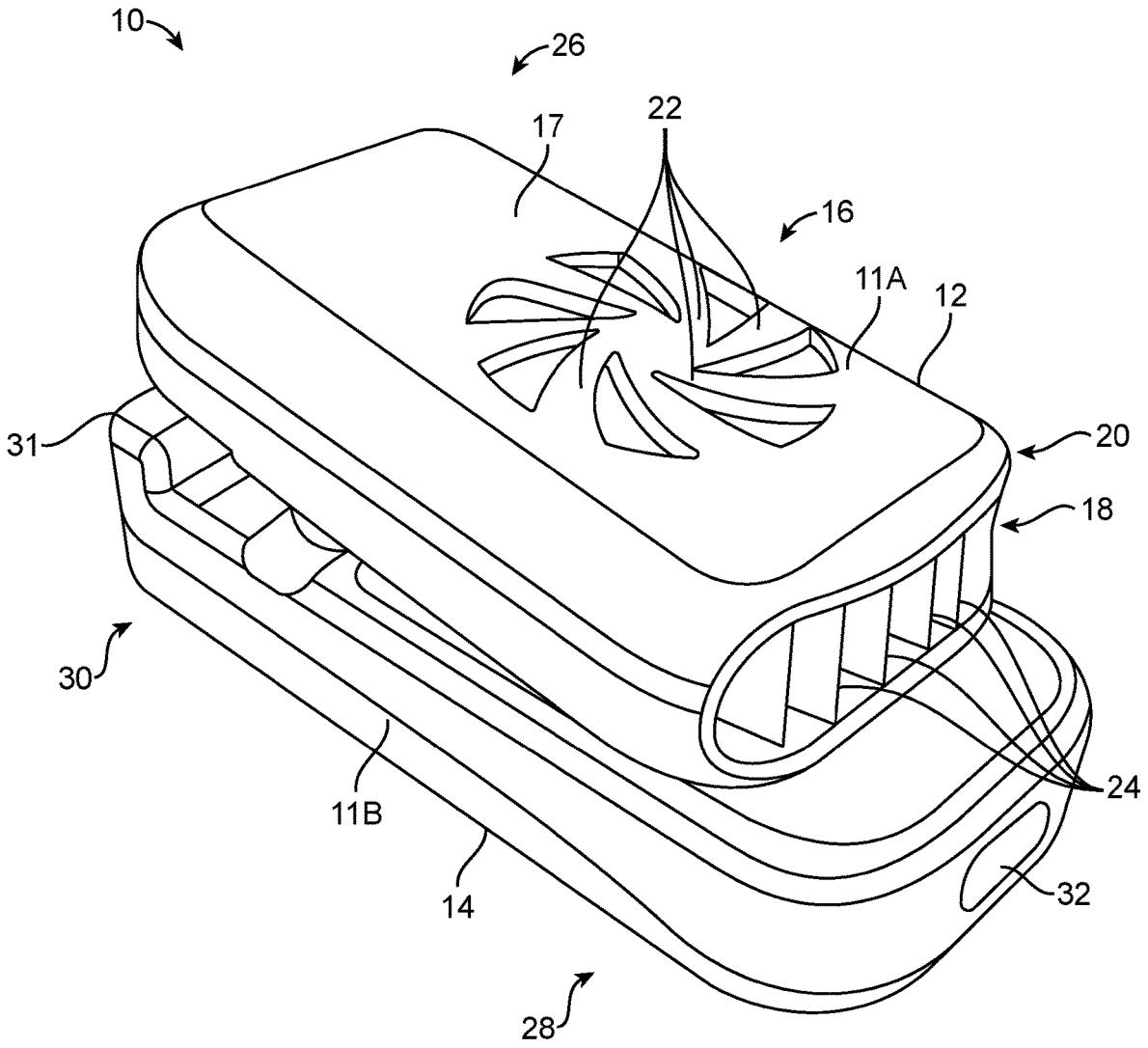
FIG. 1 is an oblique perspective view of a first side of a personal cooling device according to an aspect of the present disclosure.

Aspects of the present disclosure will be described with reference to the accompanying drawings.

DETAILED DESCRIPTION

The headings provided herein are not limitations of the various embodiments of the disclosure, which can be defined by reference to the specification as a whole. It is also to be understood that the terminology used herein is for the purpose of describing particular embodiments only, and is not intended to be limiting, since the scope of the present disclosure will be limited only by the appended claims.

For convenience, the meaning of some terms and phrases used in the specification, examples, and appended claims are provided below. Unless stated otherwise, or implicit from context, the following terms and phrases include the meanings provided below. The definitions are provided to aid in describing particular embodiments, and are not intended to limit the claimed technology, because the scope of the technology is limited only by the claims. Unless otherwise defined, all technical and scientific terms used herein have the same meaning as commonly understood by one of ordinary skill in the art to which this technology belongs. If there is an apparent discrepancy between the usage of a term in the art and its definition provided herein, the definition provided within the specification will control.

The articles "a," "an," and "the" are used herein to refer to one or to more than one (i.e., to at least one) of the grammatical object of the article. By way of example, "an element" means one element or more than one element.

As used herein, the terms "about" and "substantially" mean within an acceptable error range for the particular value as determined by one of ordinary skill in the art, which depends in part on how the value is measured or determined, i.e., the limitations of the measurement system. For example, "about" can mean within 3 or more than 3 standard deviations, per the practice in the art. Alternatively, "about" can mean a range of up to 10% (e.g., up to 5%, or up to 1%) of a given value.

The term "at least" prior to a number or series of numbers is understood to include the number associated with the term "at least," and all subsequent numbers or integers that could logically be included, as clear from context. When at least is present before a series of numbers or a range, it is understood that "at least" can modify each of the numbers in the series or range. For example, "at least 3" means at least 3, at least 4, at least 5, etc. When at least is present before a component in a method step, then that component is included in the step, whereas additional components are optional.

As used herein, the terms "comprises," "comprising," "having," "including," "containing," and the like are open-ended terms meaning "including, but not limited to." To the extent a given embodiment disclosed herein "comprises" certain elements, it should be understood that present disclosure also specifically contemplates and discloses embodiments that "consist essentially of" those elements and that "consist of" those elements.

As used herein the terms "consists essentially of," "consisting essentially of," and the like are to be construed as a semi-closed terms, meaning that no other ingredients which materially affect the basic and novel characteristics of an embodiment are included.

As used herein, the terms "consists of," "consisting of," and the like are to be construed as closed terms, such that an embodiment "consisting of" a particular set of elements excludes any element, step, or ingredient not specified in the embodiment.

FIG. 1 illustrates a personal cooling device 10. Device 10 comprises a first arm 12 and a second arm 14. Device 10 comprises a housing that, in turn comprises a first housing portion 11A and a second housing portion 11B. First housing portion 11A defines an exterior of a first arm 12 and a second housing portion 11B defines second arm 14. First arm 12 comprises a first end 20. An airflow outlet 18 is defined in the first end 20. First end 20 of first arm 12 is thus an outlet end of first arm 12. First arm 12 also comprises a second end 26 opposite first end 20. An airflow inlet 16 is defined on a side 17 of first arm 12 that extends from first end 20 to second end 26 of first arm 12. Thus, the housing of device 10 defines airflow inlet 16 on a first side of the housing and defines airflow outlet 18 on a second side of the housing, the first side being transverse to the second side. First arm 12 comprises a fan configured to draw air into the housing through airflow inlet 16 and expel air from the housing through airflow outlet 18.

In the illustrated example, airflow outlet 18 comprises vanes 24. In some examples, vanes 24 can cooperate with a shape or airflow outlet 18 to diffuse air exiting device 10. In further examples, vanes 24 can otherwise affect properties of airflow out of device 10 including, for example, velocity, pressure, and turbulence to give airflow out of the device an intended characteristic. Vanes 24 can additionally prevent external objects from entering the device's 10 housing and interfering with the fan. However, in other examples, airflow outlet 18 can lack vanes 24. In some examples, vanes 24 are immobile within airflow outlet 18. In further examples, vanes 24 can be movable within airflow outlet 18. For example, vanes 24 can be pivotably installed such that a user can manually adjust vanes' angle within airflow outlet 18 and thereby adjust an outlet airflow direction or profile. In further examples, vanes 24 can be motorized to move in response to signals from a controller included in device 10. In some examples wherein vanes 24 are motorized, vanes 24 can be controlled to change in orientation at regular intervals, such as in an oscillating pattern.

In the illustrated example, airflow inlet 16 also comprises vanes 22. Vanes 22 of airflow inlet 16 can similarly act to prevent external objects from entering the device's 10 housing and interfering with the fan. Vanes 22 can further be arranged to provide a decorative effect as shown in the illustrated example. However, in other examples, vanes 22 of airflow inlet 16 can be omitted or arranged otherwise.

Figure 2:
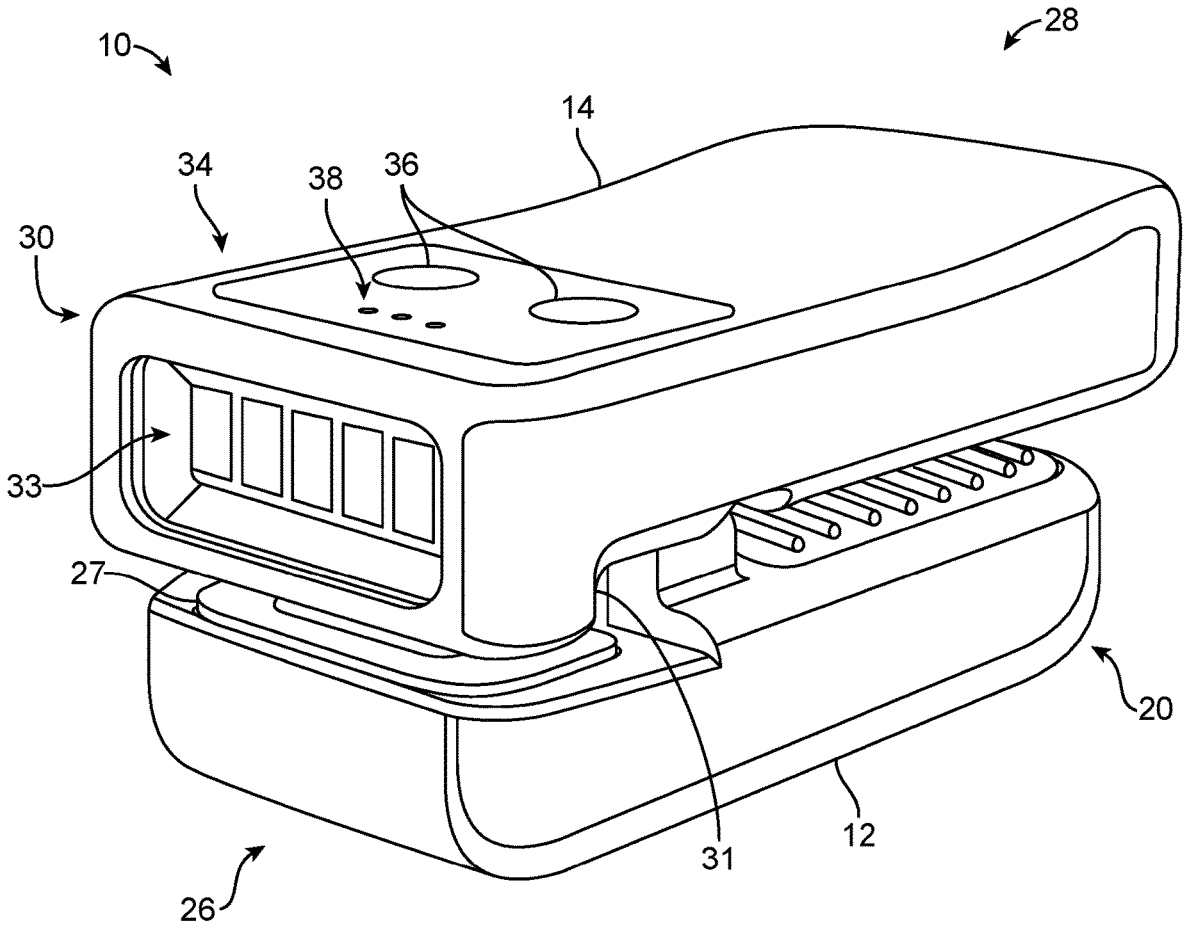
FIG. 2 is an oblique perspective view of a second side of the personal cooling device according to an aspect of the present disclosure.

Turning to FIG. 2, with continued reference to FIG. 1, second arm 14 similarly comprises a first end 28 and a second end 30 opposite the first end. Second arm 28 also comprises a port 32, shown in FIG. 1. In some examples, port 32 can be, for example, a charging port for battery 68 shown in FIG. 10A and discussed below. In further examples, port 32 can be a port for receiving a data communication cable to connect device 10 to a computing device. In some such further examples, port 32 can enable functions such as, for example, loading operating instructions, firmware, and/or software onto device 10 or communicating telemetry data from device 10 to an external computing device. Port 32 can thus be, for example, a USB port, or more specifically a USB-C port, or any other port suitable for providing a power connection, data connection, or both as needed for a given implementation. Port 32 may be omitted or provided without charging capability in implementations wherein battery 68 is wirelessly chargeable, such as using inductive charging.

Second arm 14 also comprises a light 33. Light 33 enables device 10 to act as a wearable lamp. Light 33 is configured to shine through second end 30 of second arm 14. Second end 30 of second arm 14 is thus a lamp end of second arm 14. Because second end 30 of second arm 14 is at an opposite end of device 10 from first end 20 of first arm 12 at which airflow outlet 18 is defined, light 33 shines through an opposite end of device 10 from which air driven by the fan is expelled from device 10. Thus, light 33 shines in an opposite, or at least generally opposite, direction from outlet direction 54, shown in FIG. 10A and discussed below. For example, light 33 can shine in a direction that is between 135° and 180° away from outlet direction 54. Further, light 33 shines in an opposite, or at least generally opposite, direction from receiving direction 46.

Second arm 14 also comprises control panel 34. Control panel 34 provides a switch for activating and deactivating device 10. In the illustrated example, control panel 34 comprises two buttons 36. Buttons 36 can be used to control device 10 in various ways in different implementations of the present disclosure. In some examples, one button 36 is an on button while the other button 36 is an off button. In other examples, one button 36 is an on/off toggle switch for the fan while the other button 36 causes the fan to cycle through different operating states. The different operating states can be, for example, different fan speeds or different automated fan activation and deactivation patterns. In other examples, one button 36 can be an on/off toggle switch for the fan while the other button 36 can be an on/off toggle switch for light 33. In another example, one button 36 causes the fan to cycle through different operating states while the other button 36 cause the light to cycle through different illumination intensities, colors, frequencies (such as constant illumination and strobe), and the like, and any combination thereof. In other examples, control panel 34 can comprise other numbers of buttons 36, such as only one button 36, three buttons 36, four buttons 36, or five buttons 35, or any other number.

In the illustrated example, control panel 34 further comprises indicator lights 38. Indicator lights 38 can indicate an operating state of device 10. For example, indicator lights 38 can indicate whether device 10 is on or off. In further examples, indicator lights 38 can indicate whether the fan of device 10 is running. In further examples, indicator lights 38 can indicate whether light 33 is on. In further examples, indicator lights 38 can indicate a charge state of battery 68. In further examples, such as some examples wherein one of the buttons 36 can be used to cycle through multiple operating states for device 10, indicator lights 38 can indicate which option within the cycle is currently active. In other examples, control panel 34 can lack indicator lights 38. In such examples, indicator lights 38 can be omitted from device 10 altogether or comprised by a portion of device 10 other than control panel 34. In other examples, control panel 34 can comprise indicator lights 38 in other quantities, such as only one indicator light 38, two indicator lights 38, four indicator lights 38, five indicator lights 38, or any other number.

Second end 30 of second arm 14 of the illustrated example comprises a protrusion 31 that extends toward second end 26 of first arm 12. Protrusion 31 can provide additional area for light 33. Protrusion 31 also limits a possible range of rotation of second arm 14 relative to first arm 12. Protrusion can thereby limit stress on a biasing element, such as coil spring 52 shown in FIG. 7 and discussed below, thereby improving durability of device 10. Protrusion 31 can also limit an amount of bending or displacement on any wires or other electrical connectors extending through hinge 40 between arms 12, 14, which can also improve a durability of device 10. Protrusion 31 can be opposed by a pad 27 comprised by second end 26 of first arm 12 on a side facing second arm 14. Pad 27 can be made of a softer material than a majority of first housing portion 11A and thereby provide an improved user experience by providing gradually increasing resistance as second ends 26, 30 approach an end of their respective ranges of motion wherein protrusion 31 bears on pad 27. In other examples, either or both of protrusion 31 and pad 27 can be omitted. In further examples, protrusion 31 can be comprised by first arm 12 while pad 27 is comprised by second arm 14.

Figure 3:
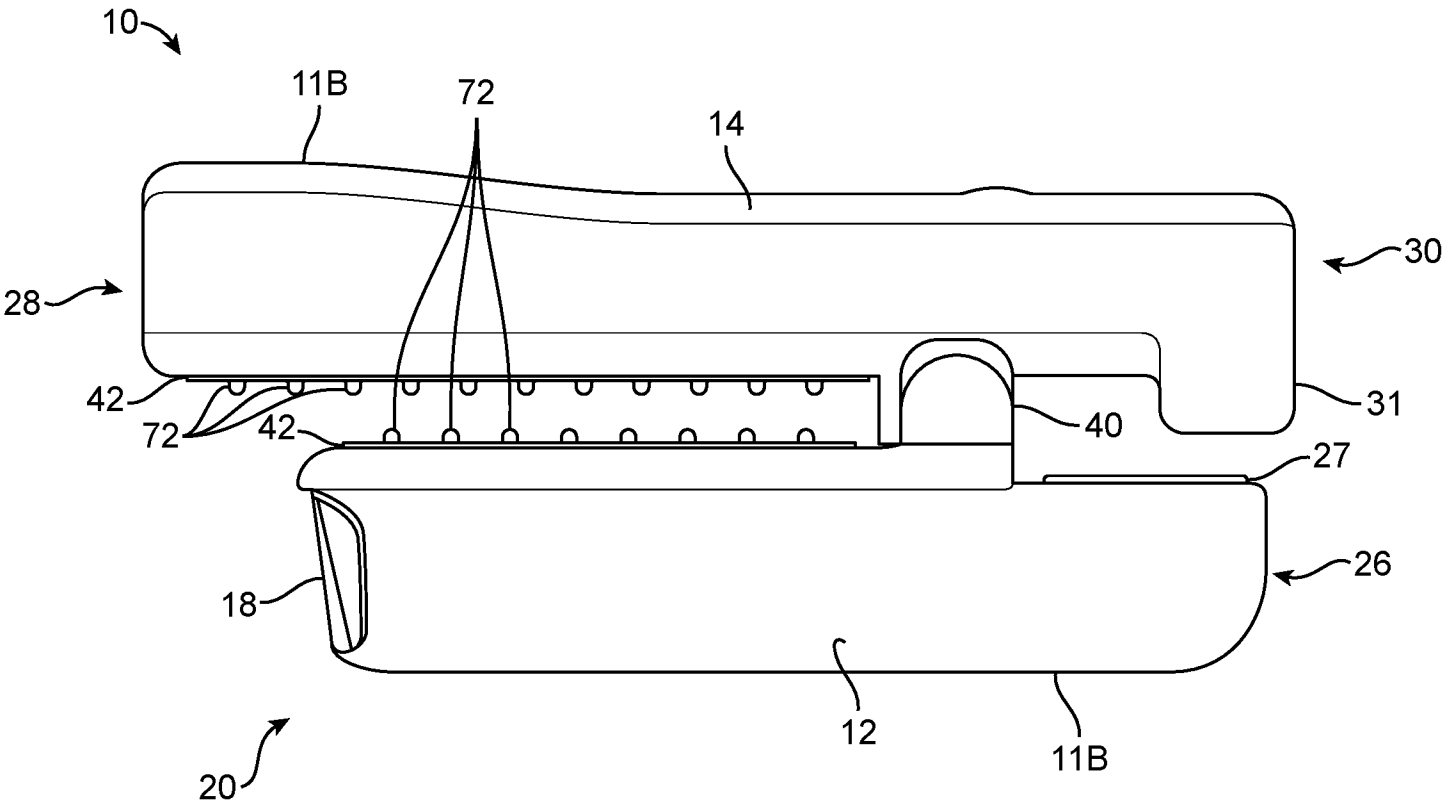
FIG. 3 is a side elevation view of the personal cooling device according to an aspect of the present disclosure in an intermediate state.
Figure 4:
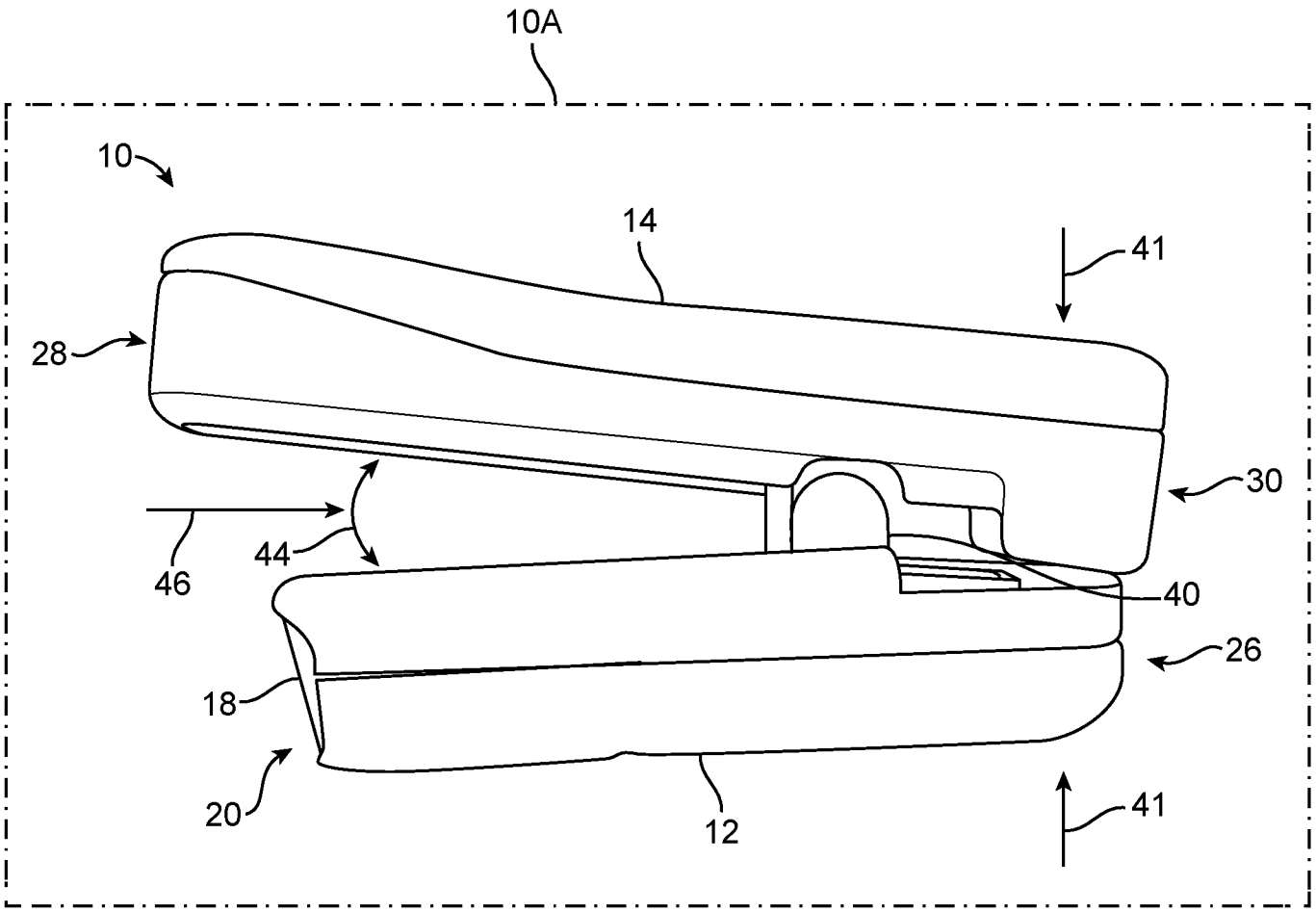
FIG. 4 is a side elevation view of the personal cooling device according to an aspect of the present disclosure in an open state.
Figure 5:
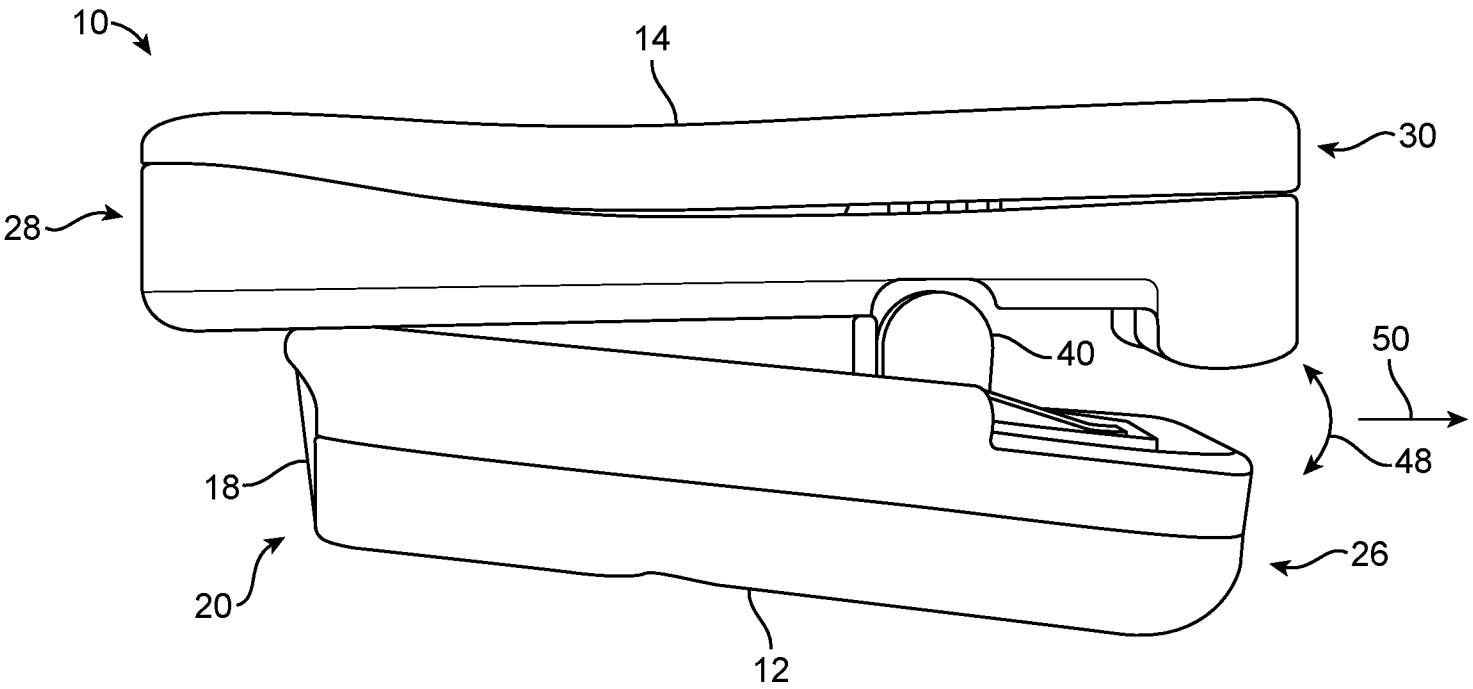
FIG. 5 is a side elevation view of the personal cooling device according to an aspect of the present disclosure in a closed state.

FIGS. 3-5 show device 10 in an intermediate state, an open state, and a closed state, respectively. First arm 12 and second arm 14 are connected by a hinge 40. In the illustrated embodiment, hinge 40 is nearer to second end 26 of first arm 12 than to first end 20 of first arm 12. Further, in the illustrated embodiment, hinge 40 is nearer to second end 30 of second arm 14 than to first end 28 of second arm 14. Both first ends 20, 28 are spaced from hinge 40. Both second ends 26, 30 are also spaced from hinge 40. However, in other examples, the position of hinge 40 and the relative proportions of parts of first arm 12 and second arm 14 may vary. Accordingly, in other examples, can be centered between the first and second end of either arm 12, 14, or both arms 12, 14, or nearer to the first end 20, 28 of either arm 12, 14 or both arms 12, 14.

Second arm 14 is biased relative to first arm 12 about hinge 40 such that the two arms 12, 14 act as a clip. Accordingly, second arm 14 is pivotably coupled to first arm 12 by hinge 40, and second arm 14 is biased relative to first arm 12 about hinge 40 to be able to secure device 10 to a garment by pinching the garment against first arm 12. For this purpose, and generally throughout the present disclosure, references to a "garment" and an "article of apparel" are used interchangeably.

Second arm 14 of the illustrated example is specifically biased relative to first arm 12 about hinge 40 to bring first ends 20, 28 of arms 12, 14 together and spread second ends 26, 30 of arms 12, 14 apart. Thus, external force, such as forces 41 bringing second ends 26, 30 of arms 12, 14 together, is necessary to move device 10 to the open state shown in FIG. 4. When external forces 41 are removed, the bias on arms 12, 14 about hinge 40 will cause device 10 to move through the intermediate state shown in FIG. 3 toward the closed state shown in FIG. 5. Thus, the bias on hinge 40 allows device 10 to pinch a garment at an end of device 10 that comprises airflow outlet 18. The bias on hinge 40 also allows the device 10 to pinch a garment at an end of device 10 opposite from light 33. In other examples, the bias on hinge could be in an opposite direction such that the bias on hinge 40 allows the device 10 to pinch a garment at an end of device 10 that comprises light 33 or is opposite from airflow outlet 18.

In the illustrated example, first ends 20, 28 of both arms 12, 14 and second ends 26, 30 of both arms 12, 14 extend beyond hinge 40 in either direction. Thus, external forces 41 as shown in FIG. 4 can be applied by pinching second ends 26, 30 of both arms 12, 14 together. Accordingly, a user can force first ends 20, 28 of both arms 12, 14 apart by pinching second ends 26, 30 of both arms 12, 14 together. A user may find the option to open device 12, 14 by pinching first arms 12, 14 more convenient than pulling first ends 26, 30 apart. Moreover, the aforementioned provision of a convenient way to open device 10 can avoid a need to apply or release device 10 by sliding arms 12, 14 along the surface of the object to which device 10 is to be attached. The aforementioned provision of a convenient way to open device 10 can thereby reduce a probability of device 10 damaging the object to which device 10 is to be mounted. Additionally, reducing or avoiding a need to slide arms 12, 14 along the surface of the object to which device 10 is to be mounted can enable provision of high-friction elements, such as grips 42, on the surfaces of arms 12, 14 intended to contact the surface of the object, thereby reducing a probability of device 10 releasing the object when not intended.

As shown in FIG. 4, an inner angle 44 is defined between first arm 12 and second arm 14 on a side of hinge 40 facing toward first end 20 of first arm 12 and first end 28 of second arm 14. Inner angle 44 is therefore defined between first arm 12 and second arm 14 on a same side of hinge 40 as airflow outlet 18. Outer angle 48 (shown in FIG. 5) is defined between first arm 12 and second arm 14 on an opposite side of hinge 40 from inner angle 44. The second arm 14 is biased relative to first arm 12 about hinge 40 to decrease inner angle 44. The second arm 14 is also biased relative to first arm 12 about hinge 40 to increase outer angle 48. Thus, absent external influence such as external forces 41, first arm 12 and second arm 14 will tend to move relative to one another about hinge 40 toward a position of lesser inner angle 44 and greater outer angle 48 until arms 12, 14 reach an end of their range of motion relative to one another at the closed position shown in FIG. 5.

A receiving direction 46 along which a garment may travel to be securably received by the clip defined by arms 12, 14 of device 10 extends through a point between first end 20 of first arm 12 and first end 28 of second arm 14 toward hinge 40. Thus, a receiving side of hinge 40 can be defined as a side of hinge 40 that a garment approaches when traveling along the receiving direction. Second arm 14 is biased relative to first arm 12 about hinge 40 to decrease an angle between first arm 12 and second arm 14 on the receiving side of hinge 40 according to that definition. Further, airflow outlet 18 is disposed on the receiving side of hinge 40 according to that definition. Airflow outlet 18 can be configured to direct air along an outlet direction 54, shown in FIGS. 9, 10A, and 10B and discussed below, that is at least 90° away from receiving direction 46. Stated another way, an angle defined between receiving direction 46 and outlet direction 54 is at least 90°. Thus, airflow outlet 18 can be configured to direct air back toward an object having an edge clipped between first arm 12 and second arm 14.

As shown in FIG. 5, a light direction 50 toward which light 33 shines can have generally the same absolute direction as receiving direction 46, but extending away from hinge 40 rather than toward hinge 40.

Each arm 12, 14 comprises a grip 42 between hinge 40 and the arms' 12, 14 respective first ends 20, 28. First end 20 of first arm 12 is thus a grip end of first arm 12 and first end 28 of second arm 14 is thus a grip end of second arm 14. On each arm 12, 14, the grip 42 faces the other arm 12, 14. Thus, the bias on hinge 40 brings the grip 42 on each arm 12, 14 nearer to the other arm 12, 14. In further examples, at least one of first arm 12 and second arm 14 comprises a grip 42 facing the other of first arm 12 or second arm 14. In further examples, either or both arms 12, 14 can lack grip 42. In the illustrated example, first arm 12 is shorter than second arm 14 such that first end 20 of first arm 12 contacts grip 42 of second arm 14 when device 10 is in the closed position. Also according to the illustrated example, a length of first arm 12 between hinge 40 and first end 20 of first arm is less than a length of second arm 14 between first end 28 and hinge 40 such that first end 20 of first arm 12 contacts second arm 14 between hinge 40 and first end 28 of first arm 14 when device 10 is in the closed position. Second arm 14 can thereby provide a significant amount of grip 42 surface area and storage space for components of device 10 while first arm 12, which includes airflow outlet 18, can occupy relatively less space. Accordingly, the illustrated proportions of device 10 enable the portion of device comprising airflow outlet 18, namely first arm 12, to be small and unobtrusive relative to the overall size of device. Device 10 can therefore be used to supply airflow to locations where a large object may be undesirable. For example, device 10 can be positioned such that first arm 12 is on an underside of a brim of a baseball cap to cool a wearer's face with minimal obstruction to a wearer's field of view. However, in other examples, lengths of arms 12, 14 relative to one another, or portions of first arm 12 and second arm 14 on either side of hinge 40, can vary.

Each grip 42 is a feature configured to increase an effective coefficient of friction between arm 12, 14 and a material or surface type to which device 10 is intended to be attached. Thus, grips 42 of the illustrated example are configured to have a greater effective coefficient of friction against fabrics than would occur between fabrics and a smooth surface of the material from which housing portions 11A, 11B are made. Grips 42 can also be constructed to reduce a likelihood of unintended damage to the material or surface type to which device 10 is intended to be attached. Accordingly, grips 42 can be made of a softer material than housing portions 11A, 11B. For example, housing portions 11A, 11B can be mostly or entirely made of a material that is rigid at room temperature while grips 42 can be mostly ore entirely made of a material that is pliable at room temperature. In some examples, housing portions 11A, 11B and grips 42 are all mostly or entirely made of polymer, but grips 42 are mostly or entirely made of a polymer that is softer than a polymer that makes up at least a majority of housing portions 11A, 11B. Grips 42 can be, for example, rubber. Housing portions 11A, 11B can be, for example, acrylonitrile butadiene styrene ("ABS"), polylactic acid ("PLA"), rigid nylon, any blend thereof, or any similar materials. In further examples, housing portions 11A, 11B can be aluminum or another similarly lightweight and rigid metal or metal composition.

Figure 6:
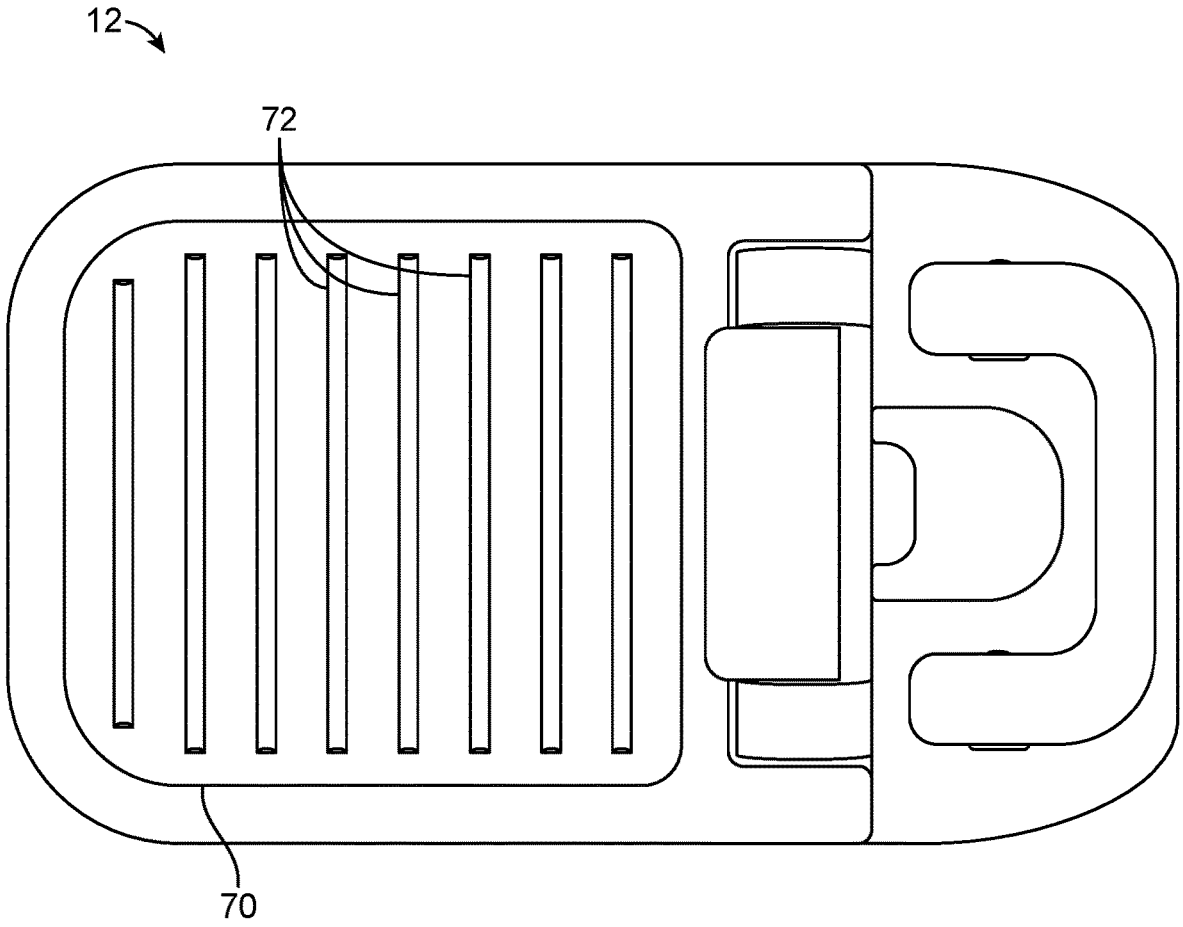
FIG. 6 is a top plan view of a first arm of the personal cooling device according to an aspect of the present disclosure.

Grips 42 can comprise textural elements to increase an effective coefficient of friction between arms 12, 14 and a material or surface type to which device 10 is intended to be attached. In the illustrated example, grips 42 comprise textural elements in the form of ribs 72. Ribs 72 extend laterally, as shown in FIG. 6, meaning parallel or at least generally parallel to the axis about which second arm 14 pivots relative to first arm 12. Ribs 72 can engage a portion of a garment pinched between arms 12, 14 to impede the garment from slipping out of device 10 while device 10 remains closed. Grips 42 in other examples can comprise differently configured textural elements or omit the textural elements altogether.

Figure 7:
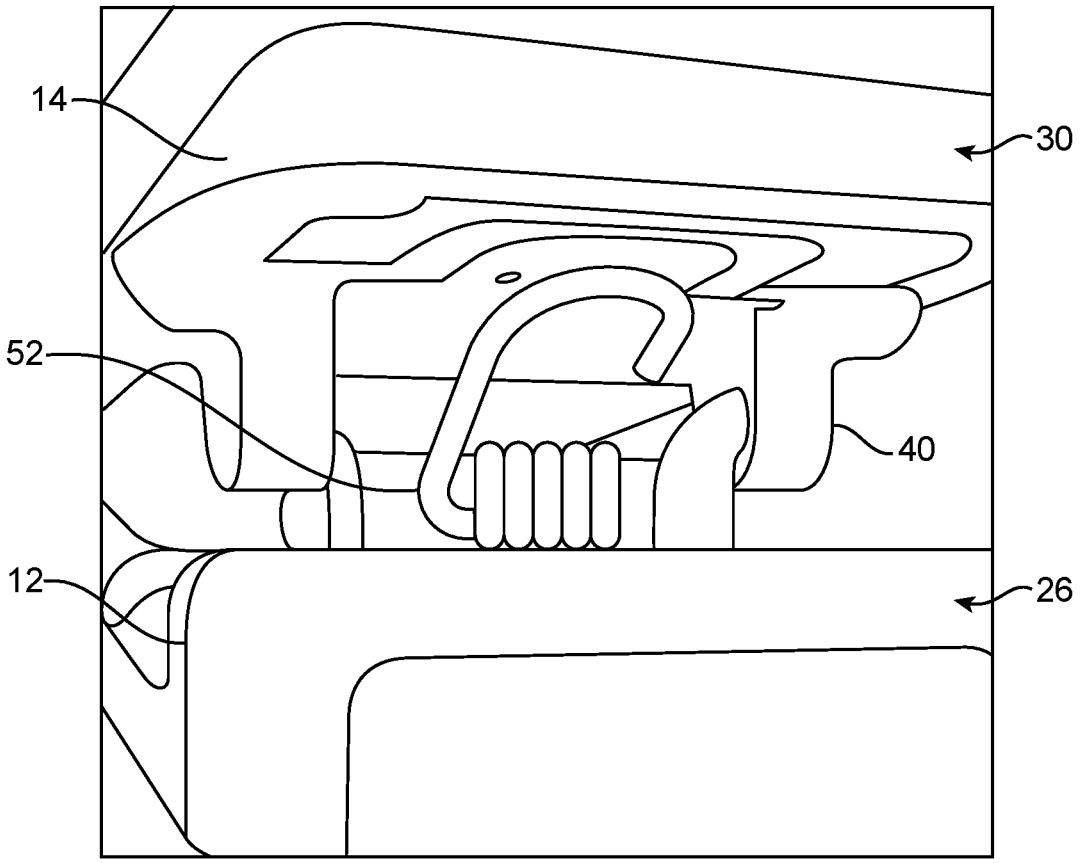
FIG. 7 is an oblique perspective view of a hinge of the personal cooling device according to an aspect of the present disclosure.
Figure 10A:
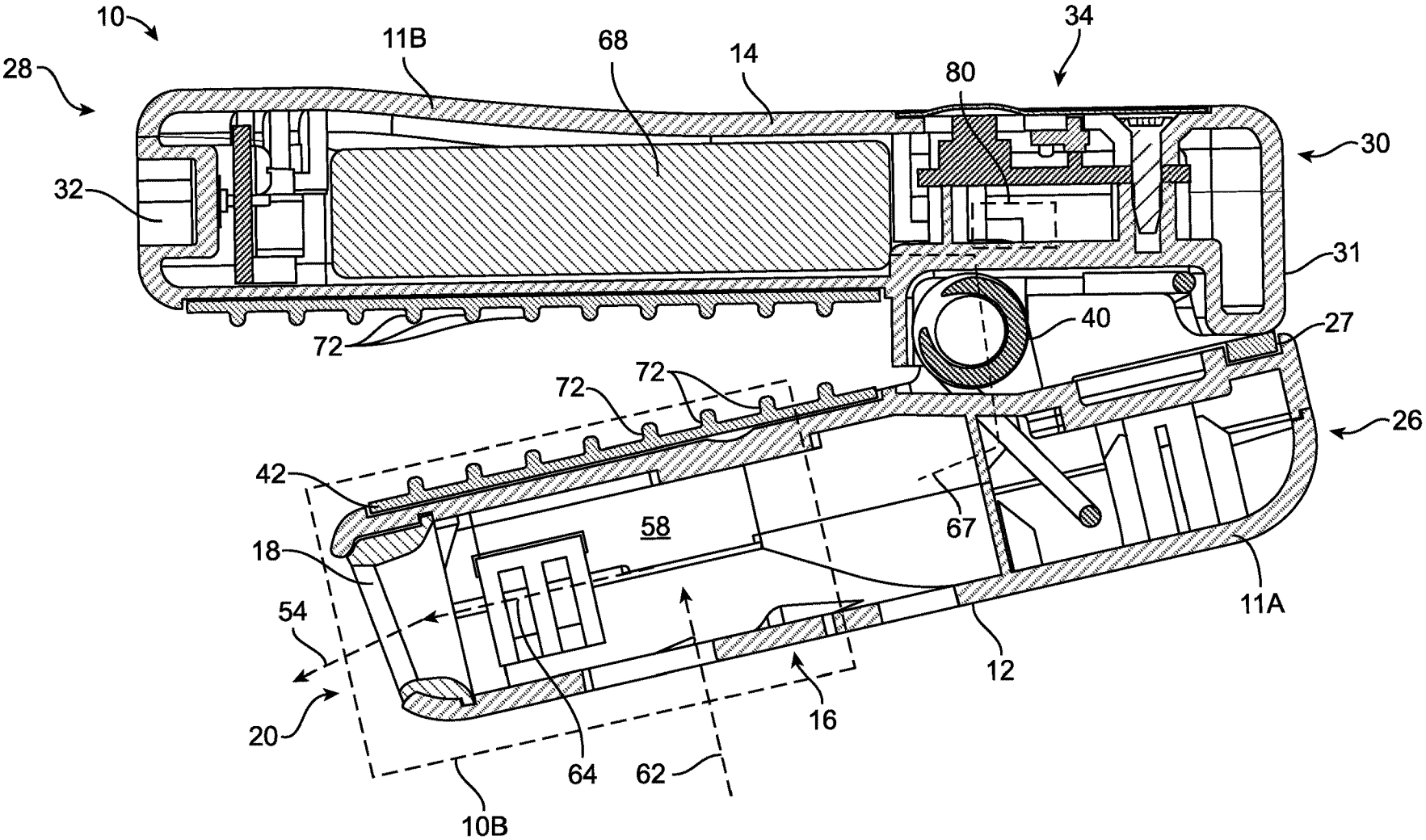
FIG. 10A is a cross-section taken on plane 10A of FIG. 4.

FIG. 7 illustrates a coil spring 52 disposed within hinge 40 to bias second arm 14 relative to first arm 12. In the illustrated example, coil spring 52 is wound about an axis of rotation hinge 40 creates for second arm 14 to pivot relative to first arm. Referring to FIG. 10A, with continued reference to FIG. 7, coil spring 52 comprises two ends extending off the axis, one extending toward second end 26 of first arm 12 and the other extending toward second end 30 of second arm 14 to bias second ends 26, 30 apart from one another. Coil spring 52 is one example of a biasing element usable to bias second arm 14 relative to first arm 12, but in other examples any other biasing element can be used. Further examples of biasing elements comprise leaf springs, coils springs oriented perpendicularly to hinge 40, and magnets.

Hinge 40 of the illustrated example is a mechanical pivoting hinge, used herein in contrast to a living hinge. Thus, first arm 12 and second arm 14 are not monolithically formed. Compared to a living hinge, mechanical pivoting hinge 40 of the illustrated example enables first hinge 12 and second hinge 14 to pivot across a relatively large range of motion for a relatively large number of repetitions before hinge 40 fails. Accordingly, use of a mechanical pivoting hinge as shown can contribute to versatility and durability of device 10. However, hinge 40 in other examples can be a living hinge.

Figure 8:
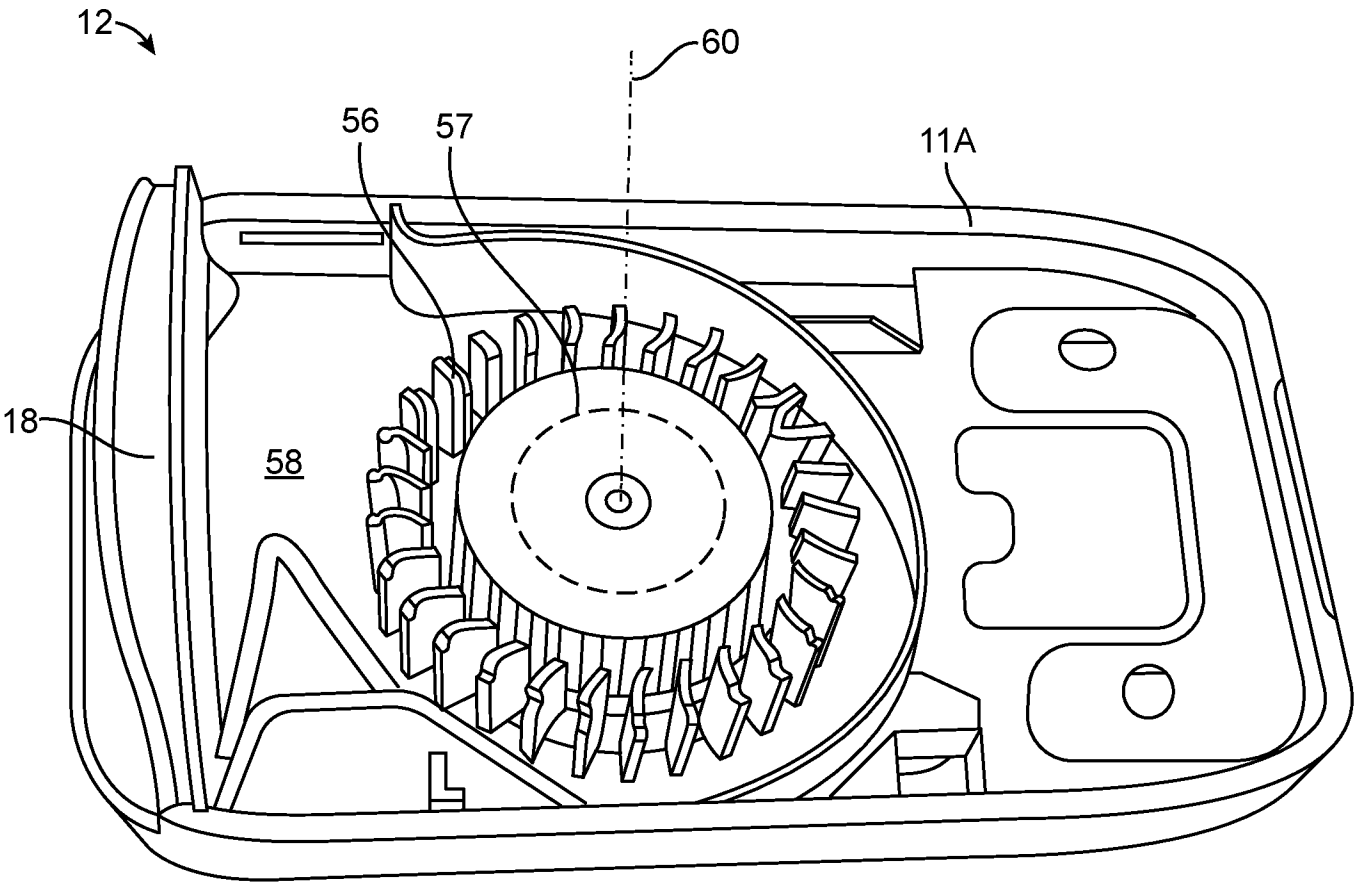
FIG. 8 illustrates a portion of a fan of the personal cooling device according to an aspect of the present disclosure.

FIG. 8 illustrates a portion of first arm 12 with a part of first housing portion 11A cut away. The fan comprised by first arm 12 comprises an impeller 56. Impeller 56 of the illustrated example is a centrifugal impeller. The fan comprised by first arm 12 further comprises a volute 58 within which impeller 56 is disposed. The fan comprised by first arm 12 therefore operates in the manner of a centrifugal blower, wherein rotation of impeller 56 draws air into volute 58 along an axis of rotation 60 of impeller 56 and expels the air from volute 58 radially relative to axis of rotation 60. Thus, as shown below in FIGS. 10A and 10B, impeller 60 draws air into first housing portion 11A through airflow inlet 16 in a direction parallel, or at least substantially parallel, to axis of rotation 60. Further, impeller 60 expels air from first housing portion 11A through airflow outlet 18 in a direction that is radial, or at least substantially radial, relative to axis of rotation 60. Also, impeller 56 expels air from first housing portion 11A through airflow outlet 18 in a direction that is normal, or at least substantially normal, to axis of rotation 60. Volute 58 can be a scroll volute. Further, as shown in the illustrated example, volute 58 can be a scroll volute wherein airflow outlet 18 is wider than the radial passage out of the scroll. Further, as shown in the illustrated example, the radial passage out of the scroll can be laterally off-center relative to airflow outlet 18. However, in other examples, volute 58 can be configured differently than in the illustrated example.

The fan that includes impeller 56 and volute 58 can be configured to provide airflow at any of a variety of volumes and speeds. In some examples, the fan can be configured to expel air through airflow outlet 18 at a rate of two cubic feet per minute ("CFM"), four CFM, about two CFM, about four CFM, between two and four CFM, between 1 and 5 CFM, 3 CFM, or about 3 CFM.

Figure 9:
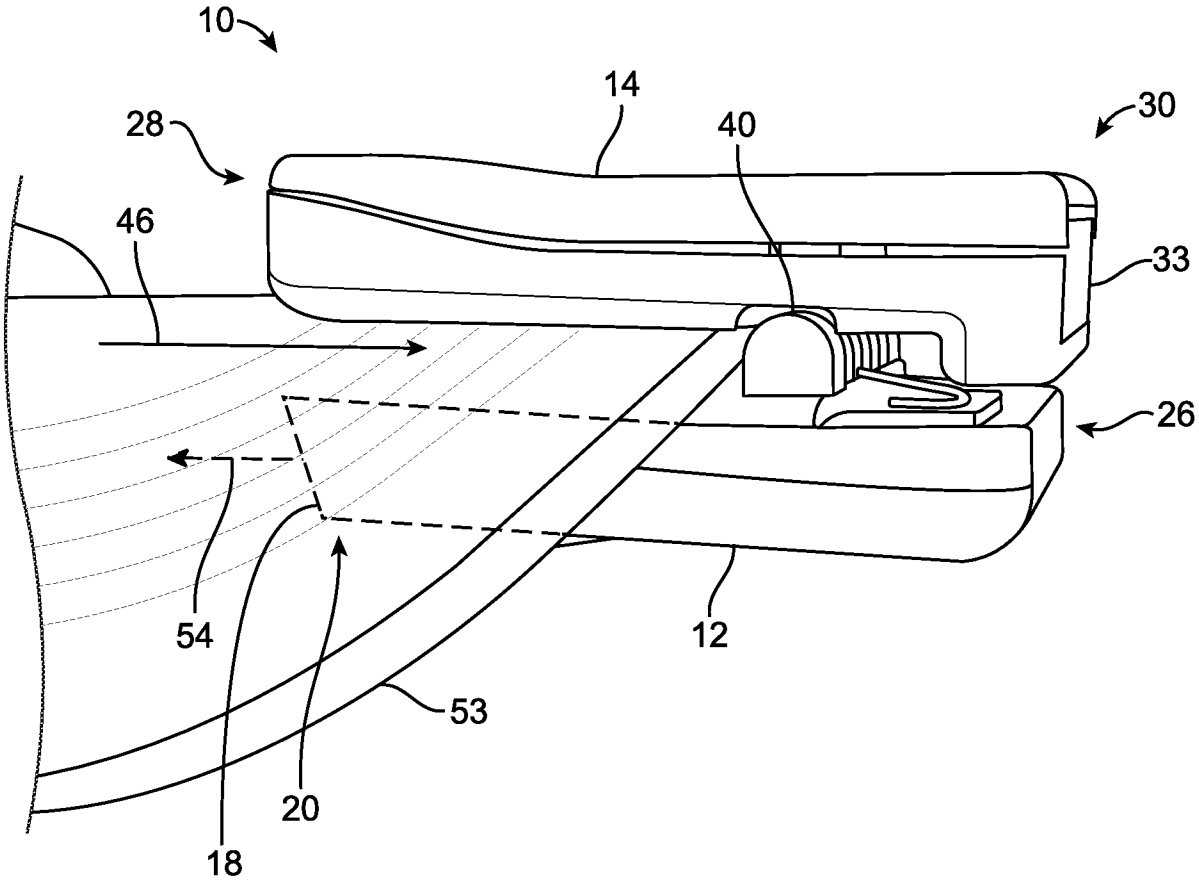
FIG. 9 illustrates the personal cooling device according to an aspect of the present disclosure attached to an article of apparel.

Impeller 56 of the illustrated example is specifically positioned within volute 58 as a forward curved centrifugal impeller, though a backward curved or straight radial impeller can be used in other examples. Further, impeller types other than centrifugal impellers can be used in other examples. However, centrifugal impeller 56 provides certain benefits within the illustrated example. Centrifugal impeller 56 creates a relatively high pressure ratio with a low profile. Thus, device 10 can be attached to a baseball cap 53 as illustrated in FIG. 9 to direct air toward a wearer's face with minimal obstruction to wearer's vision. Centrifugal impeller 56 can further contribute to a compact design for device 10 by accommodating motor 57 within the diameter and depth of impeller 56.

FIG. 9 illustrates device 10 clipped to an article of apparel 53. The article of apparel 53 is specifically a baseball cap, with device 10 being clipped to the brim or bill of the cap. Thus, in the arrangement illustrated in FIG. 9, the brim extends between first end 20 of first arm 12 and second end 28 of second arm 14 in the receiving direction 46 toward hinge 40. The second arm 14 is biased relative to first arm 12 to pinch the brim against first arm 12. Thus, the brim is clipped between first arm 12 and second arm 14. Grips 42, described above, engage the brim and reduce a likelihood that device 10 will slip off of cap 53 unintentionally. A baseball cap is just one non-limiting example of an article of apparel 53 to which device 10 may be clipped. Other non-limiting examples include articles of apparel, such as an apron, belt, bra strap, shirt collar, and the like, as well as other articles, such as backpack straps, vehicle sun visors, vehicle steering wheels, or any other article or object that device 10 is able to clip onto.

Device 10 is oriented on the brim of cap 53 such that airflow outlet 18 is positioned under the brim. Outlet 18 can therefore be directed generally toward a head or face of a wearer of cap 53. Device 10 can thus be used as a personal, wearable cooling device by clipping device 10 onto a garment or article of apparel in a position wherein outlet 18 is directed toward a wearer. As noted above, vanes 24 of airflow outlet 18 can act to diffuse air exiting device 10, thus distributing air flow across a relatively wide portion of the wearer.

Figure 10B:
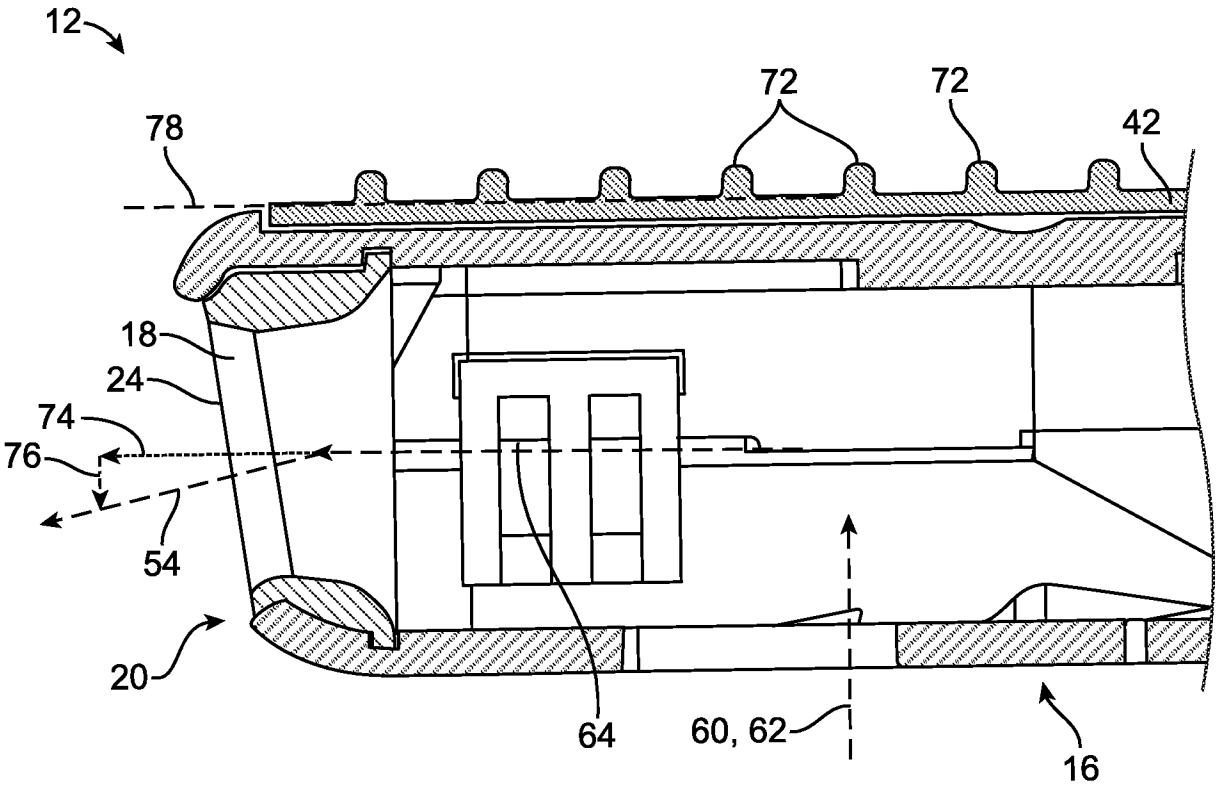
FIG. 10B is an enlarged view of portion 10B of FIG. 10A.

As shown in FIGS. 10A and 10B, volute 58 directs air out of device 10 in a radial direction relative to axis of rotation 60. Airflow outlet 18 can impart an axial, relative to axis of rotation 60, component to some air exiting device 10. Thus, airflow outlet 18 can direct at least a portion of air out of first arm 12 in an outlet direction 54. The outlet direction 54 can comprise a radial component 74 and an axial component 76 relative to axis of rotation 60. Thus, where grip 42 of first arm 12 extends on a grip plane 78 normal to axis of rotation 60 as in the illustrated example, airflow outlet 18 can be configured to direct at least some air transverse to grip plane 78. Axis of rotation 60 can be parallel, or at least substantially parallel, to an inlet direction 62 along which airflow enters volute 58 through airflow inlet 16. Axial component 76 of outlet direction 54 can be opposite an axial component of inlet direction 62. For example, while inlet direction 62 is upward from the perspective of FIG. 10B, axial component 76 of outlet direction 54 is downward from the perspective of FIG. 10B. Thus, when device is attached to a bill of a baseball cap 53 as shown in FIG. 9, at least a portion of air exiting device 10 can be directed downward toward a wearer's face.

Returning to FIG. 10A, second arm 14 comprises battery 68. Battery 68 can power any electronic aspects of device 10 mentioned herein. To that end, battery 68 can be connected to motor 57 and any other powered elements of first arm 12 by a wire or wires 67 extending through hinge 40. Battery 68 can be, for example, a 9V battery, a rechargeable Lithium-Ion battery, a rechargeable Lithium-Ion Polymer pouch cell, or any of a variety of other disposable or rechargeable power sources that a person of ordinary skill in the art would recognize to be suitable for powering aspects of device 10 disclosed herein.

As shown in FIG. 10A, in the illustrated example the fan and battery 68 are both on a same side of hinge 40. In particular, in the illustrated example motor 57 and battery 68 are both on a same side of hinge 40. The aforementioned same side of hinge 40 is the receiving side of hinge 40. Thus, the fan, or more specifically motor 57 of the fan, and battery 68 are positioned in respective portions of arms 12, 14 between which an object such as article 53 can be received. The positioning of fan and battery 68 in different arms 12, 14 on a same side of hinge 40 as described above can contribute to a useful balance and form factor of device 10. For example, positioning the fan, or at least motor 57 of the fan, in a different arm 12 from the arm 14 that comprises battery 68 enables inclusion of a relatively large impeller 56, motor 57, and battery 68 without either arm 12, 14 being too large for convenient affixation of device 10 to a wearable article 53. Moreover, positioning the fan, or at least motor 57 of the fan, and battery 68 on either side of the portion of article 53 clipped between first arm 12 and second arm 14 as shown in FIG. 9 can balance the weight of the fan and battery 68 relative to the support provided by article 53, further contributing to ease of use when even a relatively large impeller 56, motor 57, and battery 68 are used. However, in other examples, impeller 56, motor 57, and battery 68 can be positioned differently than in the illustrated example. In some other examples, impeller 56 can be located on an opposite side of hinge 40 from motor 57 or battery 68. In further examples, the fan or battery 68, or both the fan and battery 68, can be positioned to an outer side of hinge 40, such as a side of hinge 40 opposite from the receiving side.

Device 10 can further comprise a computer 80. Computer 80 can be located anywhere in device 10, including in first arm 12, second arm 14, or distributed across both first arm 12 and second arm 14. Edge computer 80 can comprise a processor and a non-transitory, computer readable medium on which instructions can be stored that, when read by the processor, can cause processor to control device 10 to enact any of the functions described above with regard to operation of control panel 34. Additional or alternative instructions stored on the medium, when read by the processor, can cause the processor to enact any of the functions described below. Computer 80 may be an edge computer. Computer 80 may include a system-on-a-chip (SoC), one or more network interfaces or modems for wired or wireless communications, one or more application specific integrated circuits (ASICs), one or more microelectromechanical systems (such as an accelerometer), and the like.

Device 10 can comprise any of a variety of sensors according to various implementations. For example, device 10 can comprise a temperature sensor for sensing ambient temperatures. In some examples, device 10 can automatically switch on motor 57 when a sensed temperature exceeds a predetermined threshold and switch off motor 57 when the sensed temperature falls below a predetermined threshold. In further examples, device 10 can respond to temperature sensor data by varying an airflow intensity from the fan comprised by first arm 12. Airflow intensity can be a product of how motor 57 is driven to rotate impeller 56. Where motor 57 is provided with a variable frequency drive or another device for operating at different speeds, airflow intensity increases as motor 57 speed, and thus higher rotation speed for impeller 56, increases. Where motor 57 can only operate at one speed, motor 57 can be switched on and off in a pattern, and in such implementations the airflow intensity of a pattern is directly related to a proportion of the pattern during which motor 57 is switched on. In either case, motor 57 can be controlled by computer 80. Thus, computer 80 can act as a controller configured to activate or deactivate the fan in response to ambient conditions detected by a sensor relative to a predetermined threshold. The sensor can be a temperatures sensor while the ambient conditions comprise ambient temperature as described above. In further examples, the sensor can be a humidity sensor while the ambient conditions comprise ambient humidity. In further examples, device 10 can comprise any of a variety of other sensors configured to detect or measure ambient conditions and computer 80 can control the fan according to measured values of those ambient conditions relative to a predefined threshold. Ambient conditions can be any external conditions that can affect an experience of a user of device 10 and be measured by a sensor.

In further examples, device 10 can comprise a temperature sensor configured to measure a temperature of battery 68. Device 10 can be configured to automatically pause charging of battery 68 when a measured temperature of battery 68 exceeds a predetermined threshold. One example of a suitable type of temperature sensor for this purpose is a negative temperature coefficient ("NTC") thermistor, though other types of temperature sensors can be used in other examples.

In further examples, device 10 can comprise a position sensor configured to determine a position of second arm 14 relative to first arm 12 about hinge 40. The position sensor can be a switch coupled to first arm 12 or second arm 14. Device 10 can be configured to activate motor 57 automatically when inner angle 44 is detected to be below a predetermined threshold, or when inner angle 44 is detected to remain within a predetermined range indicative of device 10 being clipped to a specific object, such as a brim of a baseball cap, and to deactivate motor 57 automatically in other conditions. Thus, device 10 can be configured to activate or deactivate motor 57 of fan in response to actuation of the switch. In further examples, device 10 can comprise a sensor configured to determine whether an object is received between arms 12, 14. In some such examples, motor 57 can be automatically activated when the sensor detects an object received between arms 12, 14 and automatically deactivated when the sensor does not detect an object received between arms 12, 14. In some such examples, one arm can comprise an emitter, such as a light emitter, while the other arm comprises a receiver to provide the sensor. An object can be detected when the emission from the emitter is not detected by the receiver.

In further examples, device 10 can comprise a proximity sensor configured to detect a proximity of an object, such as a wearer's skin, to airflow outlet 18. In such examples, device 10 can be configured to automatically generate greater airflow intensity when the object is relatively far from airflow outlet 18 and lesser airflow intensity when the object is relatively near to airflow outlet 18. In still further examples, device 10 can comprise a directional temperature sensor, such as an infrared temperature sensor, to detect a temperature of an object toward which airflow outlet 18 is directed. In such embodiments, airflow intensity can increase with increasing temperatures detected by the directional temperature sensor. For example, airflow intensity can increase as a measurement of wearer's skin temperature increases.

Computer 80 can further comprise a wireless transceiver for telemetry. The telemetry data can comprise any measurements received from any of the above described sensors. Device 10 can further comprise either or both of a clock and location detection device, such as a global positioning system ("GPS"), to pair either or both of time and location with any other data or measurements created by device 10 to create telemetry data. Such telemetry data can be transmitted to a remote computer where it can be aggregated for insights relating to travel patterns, patterns in activity level over time, heat variations across location and time, and usage patterns over location and time. Where the remote computer aggregates telemetry data from a fleet of workers provided with devices 10, the insights can relate to burden on the workers or to locations or times associated with hazardous conditions such as elevated heat. Device 10 can operate to switch motor 57 on or off or vary airflow intensity in response to such insights, such as by increasing airflow intensity during times of day or at locations found to be associated with higher temperatures. Device 10 can comprise a notification system in the form of a speaker or lights 33, 38 configured to warn a user when unsafe conditions, such as elevated heat, are detected by any of the above described sensors or when factors associated with unsafe conditions, such as times of day or locations found to be associated with higher temperatures, are detected.

The foregoing description and related figures relate to certain examples of the concepts of the present disclosure. However, variations upon those examples are contemplated by the inventors and also come within the scope of the present disclosure. In some such further examples, elements disclosed above as being comprised by either first arm 12 or second arm 14 can be comprised by the other arm 12, 14 in any combination except for first ends 20, 28 and second ends 26, 30. For example, any one or any combination of port 32, light 33, control panel 34, and battery 68 can be comprised by the same arm as impeller 56 and volute 58.

It is to be appreciated that the Detailed Description section, and not the Summary and Abstract sections, is intended to be used to interpret the claims. The Summary and Abstract sections may set forth one or more but not all exemplary embodiments of the present invention as contemplated by the inventor(s), and thus, are not intended to limit the present invention and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

The claims in the instant application are different than those of the parent application or other related applications. The Applicant therefore rescinds any disclaimer of claim scope made in the parent application or any predecessor application in relation to the instant application. The Examiner is therefore advised that any such previous disclaimer and the cited references that it was made to avoid, may need to be revisited. Further, the Examiner is also reminded that any disclaimer made in the instant application should not be read into or against the parent application.

What is claimed is:

1. A personal cooling device, comprising:

a first arm comprising a fan, wherein the fan comprises a centrifugal impeller;

a second arm comprising a battery and pivotably coupled to the first arm by a hinge, wherein the second arm is biased relative to the first arm about the hinge and configured to secure the device to an article by pinching the article between the first arm and the second arm;

a switch configured to detect whether an object is retained between the first arm and the second arm; and a controller configured to activate the fan when the switch detects that an object is retained between the first arm and the second arm;

wherein the second arm is biased relative to the first arm about the hinge to bring the fan and the battery closer together.

2. The personal cooling device of claim 1, wherein:

the first arm comprises a first end, a second end opposite the first end, and an airflow outlet defined in the first end, the airflow outlet being configured to direct air radially away from the impeller, and the hinge is disposed nearer to the second end of the first arm than the first end of the first arm.

3. The personal cooling device of claim 2, wherein the first arm comprises an airflow inlet disposed in a housing of the first arm and configured to receive air axially relative to the impeller.

4. The personal cooling device of claim 1, wherein the first arm comprises:

a volute within which the impeller is disposed;

an airflow inlet disposed in a housing of the first arm and configured to allow air into the volute along an axis of rotation of the centrifugal impeller; and an airflow outlet configured to direct air out of the volute and out of the first arm radially relative to the axis of rotation of the centrifugal impeller.

5. The personal cooling device of claim 4, wherein the volute is a scroll volute.

6. The personal cooling device of claim 4, wherein the airflow outlet directs a portion of air out of the first arm in an outlet direction, the outlet direction comprising both a radial component and an axial component relative to the axis of rotation of the centrifugal impeller.

7. The personal cooling device of claim 6, wherein the axial component is an outlet axial component and the airflow inlet is configured to allow air into the volute in an inlet direction, wherein the inlet direction comprises an inlet axial component, and the outlet axial component is opposite from the inlet axial component.

8. The personal cooling device of claim 1, wherein:

the first arm comprises an outlet end and an airflow outlet defined in the outlet end, wherein the airflow outlet is configured to direct air radially away from the impeller, and the outlet end is disposed on a receiving side of the hinge, the second arm comprises a grip end that is on the receiving side of the hinge, and the second arm is biased relative to the first arm about the hinge toward decreasing an angle between the first arm and the second arm on the receiving side of the hinge.

9. The personal cooling device of claim 8, further comprising:

an outer side that is opposite from the receiving side of the hinge; and a light configured to direct light from the outer side.

10. The personal cooling device of claim 9, wherein the second arm comprises a lamp end opposite from the grip end, and the light is directed through the lamp end.

11. The personal cooling device of claim 8, wherein either or both of the first arm and the second arm comprises a grip facing the other of the first arm and the second arm on the receiving side of the hinge.

12. The personal cooling device of claim 11, wherein the first arm comprises the grip, and the grip extends on a grip plane and the airflow outlet is configured to direct airflow transverse to the grip plane as the airflow exits the personal cooling device.

13. The personal cooling device of claim 11, wherein the second arm comprises the grip, and a distal end of the grip end is further from the hinge than a distal end of the outlet end such that the second arm is biased about the hinge to bring the grip into contact with the outlet end.

14. A personal cooling device, comprising:

a housing;

a clip defined at least partially by the housing and configured to receive a portion of a garment to releasably secure the housing to the garment, the clip comprising a first arm and a second arm coupled by a pivoting mechanical hinge;

a fan configured to draw air through an inlet in the housing in an inlet direction and expel the air in an outlet direction that is transverse to the inlet direction;

a switch configured to detect whether an object is retained by the clip; and a controller configured to activate the fan when the switch detects that an object is retained by the clip;

wherein the first arm comprises the fan and the second arm comprises a battery.

15. The personal cooling device of claim 14, wherein:

the first arm and the second arm each comprise a respective end spaced from the hinge, a receiving direction along which a garment may travel to be securably received in the clip extends through a point between the respective ends of the first arm and the second arm toward the hinge, and an angle defined between the receiving direction and the outlet direction is at least 90°.

16. The personal cooling device of claim 14, wherein the housing comprises a first portion and a second portion, wherein the first portion contains the fan and the second portion is movable relative to the first portion.

17. The personal cooling device of claim 16, wherein the switch is coupled to the second portion of the housing, and the controller is configured to activate or deactivate the fan in response to actuation of the switch.

18. The personal cooling device of claim 14, further comprising:

a sensor configured to detect ambient conditions; and a controller configured to activate or deactivate the fan in response to the ambient conditions detected by the sensor relative to a predetermined threshold.

19. The personal cooling device of claim 18, wherein the sensor is a thermometer and the ambient conditions comprise temperature.

* * * * *